US009776754B2

(12) United States Patent
Mahar et al.

(10) Patent No.: US 9,776,754 B2
(45) Date of Patent: Oct. 3, 2017

(54) INTEGRATED CAPPER SYSTEM

(71) Applicant: Humana Inc., Louisville, KY (US)

(72) Inventors: Michael Mahar, Phoenix, AZ (US); Atin Kapadia, Chandler, AZ (US)

(73) Assignee: HUMANA INC., Louisville, KY (US)

( * ) Notice: Subject to any disclaimer, the term of this patent is extended or adjusted under 35 U.S.C. 154(b) by 563 days.

(21) Appl. No.: 14/452,897

(22) Filed: Aug. 6, 2014

(65) Prior Publication Data

US 2016/0355291 A1 Dec. 8, 2016

Related U.S. Application Data

(60) Provisional application No. 61/862,794, filed on Aug. 6, 2013.

(51) Int. Cl.

| | |
|---|---|
| ***B65B 57/02*** | (2006.01) |
| ***B65B 7/28*** | (2006.01) |
| ***B65D 41/62*** | (2006.01) |
| *B67B 3/26* | (2006.01) |

(52) U.S. Cl.

CPC ..... *B65B 57/02* (2013.01); *B65B 7/2807* (2013.01); *B65B 7/2842* (2013.01); *B65D 41/62* (2013.01); *B65B 2210/04* (2013.01); *B67B 3/26* (2013.01); *B67B 2201/03* (2013.01)

(58) Field of Classification Search

CPC ..... B65B 57/00; B65B 57/02; B65B 57/04; B65B 57/10; B65B 7/00; B65B 7/16; B65B 7/28; B65B 7/2835; B65B 7/2842; B67B 2201/03; B67B 3/204; B67B 3/2053; B67B 3/22; B65D 41/62

USPC ..... 53/52, 64, 65, 128.1, 129.1, 154, 167, 53/168, 170, 202, 285, 287, 507, 286

See application file for complete search history.

(56) References Cited

U.S. PATENT DOCUMENTS

| | | | | | |
|---|---|---|---|---|---|
| 2,963,837 | A * | 12/1960 | Dimond | B67B 3/22 | 53/129.1 |
| 3,494,094 | A * | 2/1970 | Downs | B65D 41/12 | 53/129.1 |
| 4,683,016 | A * | 7/1987 | Dutt | B29C 65/02 | 156/69 |
| 4,773,204 | A * | 9/1988 | Rydstrom | B67B 3/26 | 53/313 |
| 6,256,967 | B1 * | 7/2001 | Hebron | B65B 57/20 | 53/131.3 |
| 6,317,648 | B1 * | 11/2001 | Sleep | B65B 5/103 | 53/500 |
| 6,892,512 | B2 * | 5/2005 | Rice | B65B 5/103 | 53/168 |
| 7,765,776 | B1 * | 8/2010 | Leu | B65B 5/045 | 53/131.4 |
| 7,770,357 | B2 * | 8/2010 | Yuyama | B65B 5/103 | 53/167 |

(Continued)

*Primary Examiner* — Hemant M Desai
*Assistant Examiner* — William A Weller
(74) *Attorney, Agent, or Firm* — Standley Law Group LLP

(57) ABSTRACT

An integrated conveyor line system for placing safety and non-safety caps onto bottles traveling on the same conveyor line. A network of sensors and RFID readers determine the location of bottles and ensure that the right cap is placed on each bottle. The processing system controlling the hardware components instructs the appropriate components to divert bottles to a reject holding queue when the system detects a bottle having the wrong type of cap.

20 Claims, 4 Drawing Sheets

(56) References Cited

U.S. PATENT DOCUMENTS

| | | | | |
|---|---|---|---|---|
| 7,770,364 | B1 * | 8/2010 | Leu | B65B 5/045 53/287 |
| 7,997,048 | B2 * | 8/2011 | Bernhard | B67B 3/2033 53/253 |
| 8,328,082 | B1 * | 12/2012 | Bochenko | A61J 1/00 235/375 |
| 8,387,776 | B2 * | 3/2013 | Buchkremer | B65G 43/00 184/15.3 |
| 8,745,961 | B2 * | 6/2014 | Terzini | A61J 7/0084 53/135.2 |
| 9,514,131 | B1 * | 12/2016 | Bochenko | G06F 17/30 |
| 2010/0037557 | A1 * | 2/2010 | Wilhelm | B65B 7/2807 53/331.5 |
| 2010/0185458 | A1 * | 7/2010 | Newcomb | G06F 19/3462 705/2 |
| 2014/0165506 | A1 * | 6/2014 | Deppermann | B65B 43/44 53/471 |

* cited by examiner

INTEGRATED CAPPER SYSTEM

CROSS-REFERENCE TO RELATED APPLICATIONS

This application claims priority to U.S. Provisional Patent Application No. 61/862,794, titled INTEGRATED CAPPER SYSTEM and filed Aug. 6, 2013, the contents of which is incorporated herein by reference.

BACKGROUND OF THE INVENTIVE FIELD

Many health benefit plan providers and retail pharmacies now offer their clients the option of obtaining prescription drugs by mail. Mail order pharmacies ship prescription drugs to a client's home so the client is not required to visit a pharmacy and to fill a prescription in person. For clients with chronic conditions or other conditions that require maintenance drugs, a mail order prescription program is an attractive benefit because it is more convenient for the clients and typically less expensive than obtaining prescription drugs at a neighborhood pharmacy. For many drugs, clients have the option of purchasing a drug fill in a 60-day or even a 90-day supply at a lower cost than a 30-day supply.

Many mail order pharmacies use automated systems and dispensing lines to process and ship a high volume of prescriptions on a daily basis. Depending upon how the technology is implemented and deployed within a mail order pharmacy, a substantial number of steps in the fulfillment process may be automated and the need for human intervention minimized. Mail order pharmacies operated in the US, like their neighborhood counterparts, must be licensed in a state and are subject to numerous rules and regulations established by the licensing state's board of pharmacy.

The present invention is directed to a bottle or vial conveyor system and process. The present invention relates to an integrated bottle capper system for providing standard ("non-safety") caps and safety caps on the same conveyor line. The preferred embodiment of the present invention allows for a more efficient and faster automated system allowing greater throughput. More particularly, the preferred embodiment of the present invention includes a sensor along the conveyor line for checking to determine whether the right cap is on the bottle. If the right cap is not on the bottle, the system is configured to divert it from the conveyor line to a reject holding queue.

SUMMARY OF THE GENERAL INVENTIVE CONCEPT

In one embodiment of the present invention, a conveyor line system for placing non-safety caps and safety caps onto bottles, is comprised of a conveyor line for transporting bottles, wherein each of the bottles on the conveyor line are labeled with a barcode and carried in a container having an RFID tag; a first device adapted to place non-safety caps onto bottles on the conveyor line; a second device adapted to place safety caps onto bottles on the conveyor line; a first RFID reader for reading the RFID tag of containers on the conveyor line as they pass near the location of the second device; a first sensor for sensing if the bottles passing the first sensor have a safety cap; a second RFID reader for reading the RFID tag of containers on the conveyor line as they pass near the location of the first sensor; a database in communication with the processing system for storing information including the RFID information of the containers and barcode of the bottles carried in the containers; a processing system for processing information from the first and second RFID readers and first sensor, the processing system programmed with one or more software routines executing on the processing system to: 1) process information from the first RFID reader and to provide instructions to the second device to place a safety cap onto the bottles if the system determines the bottles need a safety cap; 2) process information from the first sensor and second RFID reader and to determine if the bottles have the correct type of cap.

The conveyor line system may also have a holding platform connected to the conveyor line; a mechanism for diverting bottles off the conveyor line onto the holding platform; and wherein the processing system is programmed with one or more software routines executing on the processing system to provide instructions to the mechanism to divert the bottles to the holding platform if the wrong cap is on the bottles. The holding platform reduces backlog on the conveyor line by allowing removal of bottles with the wrong cap from the conveyor line and allowing bottles, with or without safety caps as required, to continue processing.

The conveyor line system may also have a second sensor at, or near, the mechanism for diverting bottles for sensing the bottles passing the second sensor; and wherein the processing system is programmed with one or more software routines executing on the processing system to process information from the second sensor and to provide instructions to the mechanism for diverting bottles to the holding platform based on the information from the second sensor. In one embodiment, the mechanism for diverting is a pneumatic-driven bar.

In the preferred embodiment, the database is configured so that the RFID information of each of the containers is linked to a barcode of the bottle each container carries.

BRIEF DESCRIPTION OF THE DRAWINGS

The following detailed description of the example embodiments refers to the accompanying figures that form a part thereof. The detailed description provides explanations by way of exemplary embodiments. It is to be understood that other embodiments may be used having mechanical and electrical changes that incorporate the scope of the present invention without departing from the spirit of the invention.

In addition to the features mentioned above, other aspects of the present invention will be readily apparent from the following descriptions of the drawings and exemplary embodiments, wherein like reference numerals across the several views refer to identical or equivalent features, and wherein.

DETAILED DESCRIPTION OF EXEMPLARY EMBODIMENT(S)

Figure 1:
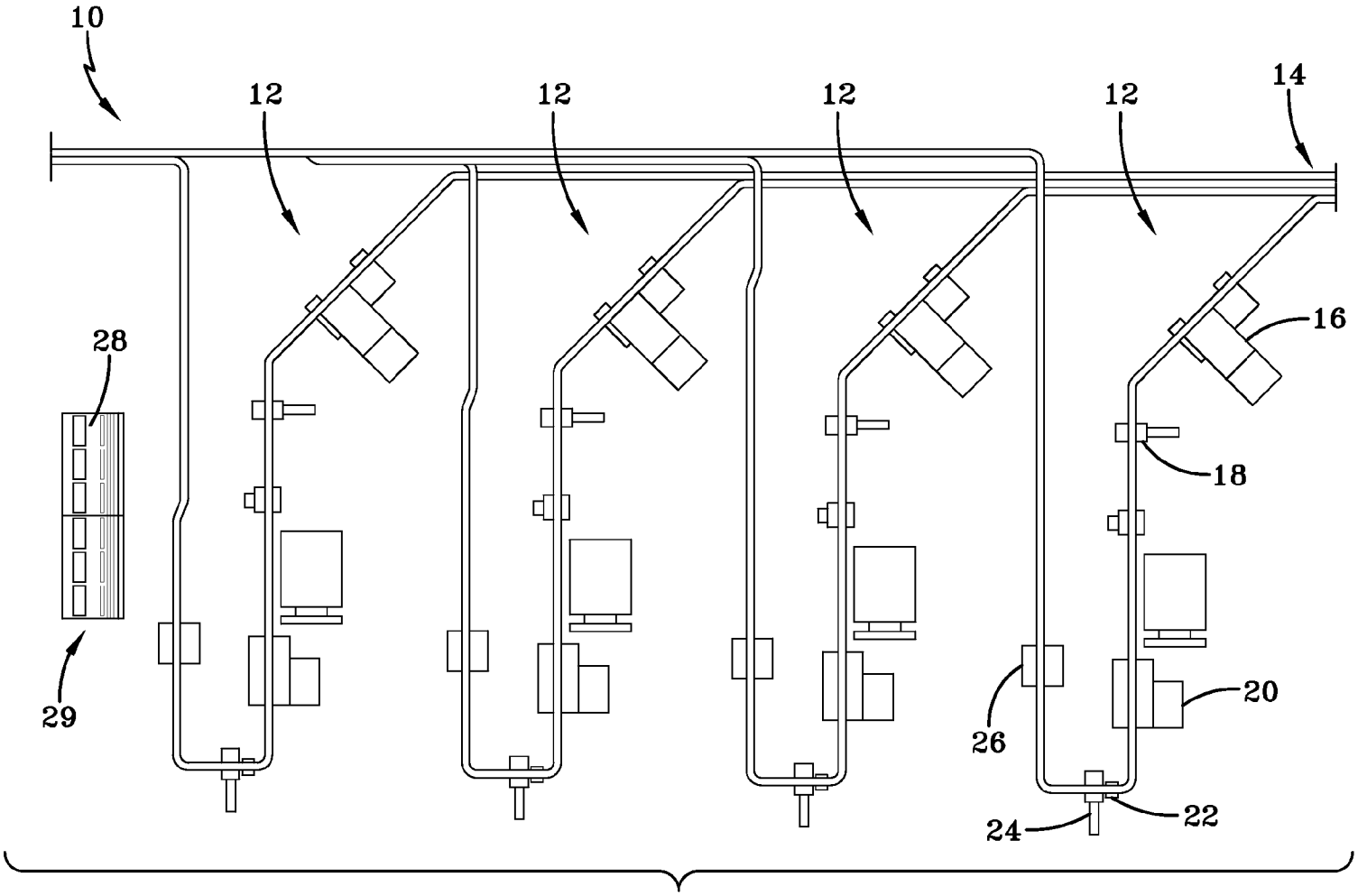
FIG. 1 illustrates one embodiment of the system of the present invention showing the conveyor system from a top view.

FIG. 1 illustrates one embodiment of the system of the present invention 10 showing the conveyor system from a top view. In this embodiment, there are four integrated capper loops 12 The four capper loops are preferably connected to four different conveyor lines 14 for delivering bottles of pills through the capper loops and eventually to sorter locations and bagger stations downstream. In one embodiment of the invention, the conveyor system for placing caps on bottles ("capper" system) is comprised of a device 16 for placing standard caps ("nonsafety" caps) onto bottles, a foil check station 18 for checking to ensure that the "nonsafety" caps for the presence of foil and ensure that the cap is not cross-threaded, a device 20 for placing safety caps (e.g., ring caps) onto the bottle if needed, a sensor station 22 with a RFID reader for determining if the right cap is on the bottle, a reject holding queue 24, and puck check station 26 with a barcode reader and another RFID reader for determining if the right bottle is in the right puck 30. A "puck" is a holder for the pill bottle that has a RFID tag built into it that is used to track the bottle as it moves along the conveyor. In the preferred embodiment, a particular bottle is "married" to the puck at the beginning portion of the conveyor line (e.g., at the bottle labelers) by placing a bar-coded label on the bottle and placing it in the puck while linking the RFID tag in the puck to the barcode on the bottle. Accordingly, tracking of the bottle can be accomplished through the RFID tag or chip, barcode, or both and checks can be conducted along the conveyor line to ensure that the right bottle is in the right puck. A processing system 28 communicates with the components of the capper loop system and is configured to take the data from the components to provide control of the capper loop system as described in more detail below.

In the preferred embodiment, the processing system is in communication with a database, shown generally at 29, for storing configuration data as well as data relating to the bottles, RFID data, and conveyor line data (e.g., feedback data from the conveyor line). For example, the database will store the barcode data of the individual bottles set at the labeler stations and the RFID data of the puck that the bottle is placed into. These two pieces of information are preferably linked so that the system can track the puck, and the bottle it carries, as it moves through the conveyor line. Other information can also be stored such as the type of cap the bottle requires (safety or not), the type of medication the bottle holds, and any other type of information that the conveyor system may need to ensure that the right medication gets placed into the bottle, with the right order, and with the right packaging.

Figure 2:
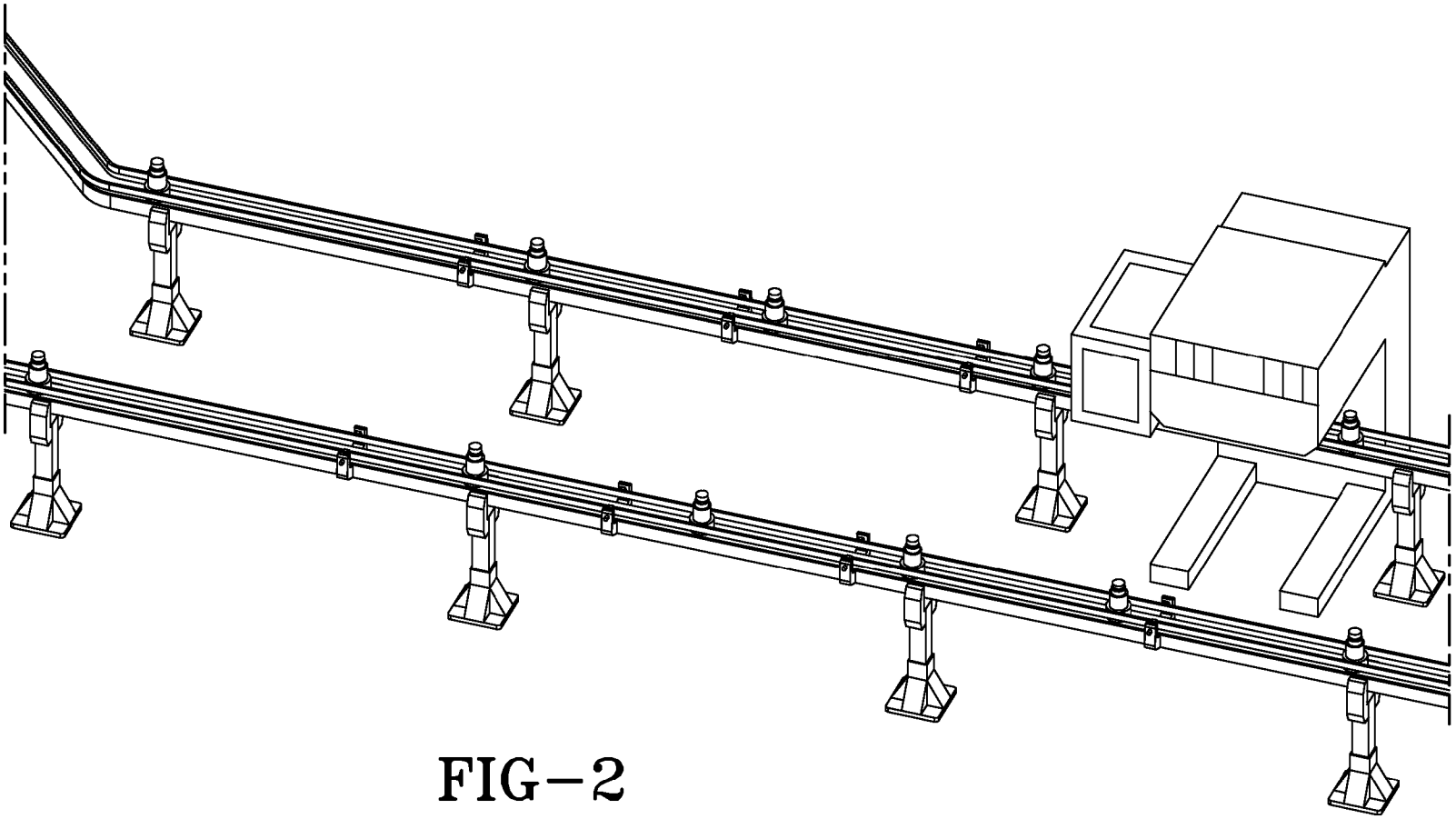
FIG. 2 illustrates one embodiment of the system of the present invention from a side perspective view.
Figure 3A:
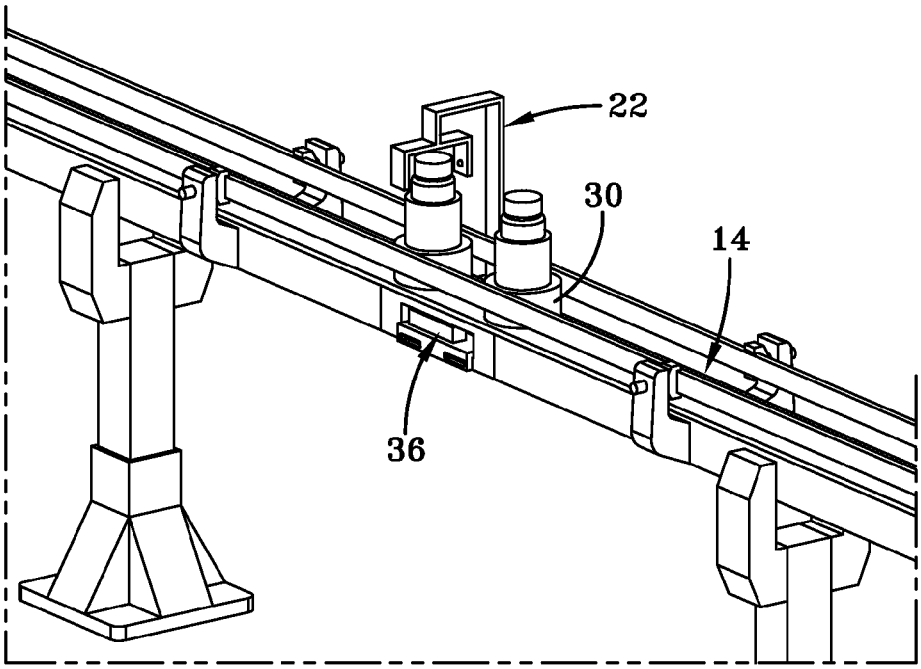
FIGS. 3A and 3B illustrate one embodiment of the sensor station of the present invention.
Figure 3B:
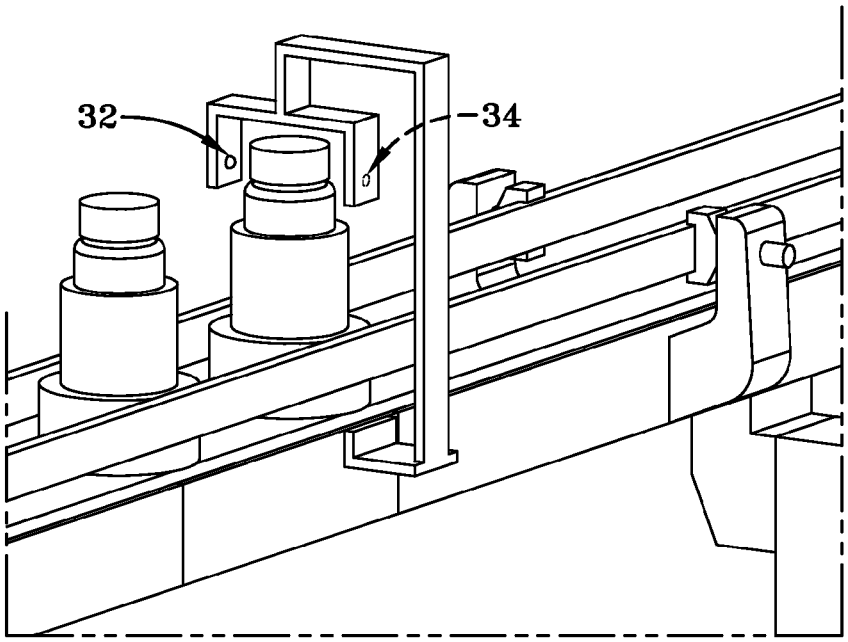

FIG. 2 illustrates the system of FIG. 1 from a side perspective view. FIG. 2 illustrates the bottles as they move along the conveyor line and capper loop of the present invention. In the embodiment shown in FIGS. 1 and 2, as a bottle moves along the conveyor line a "nonsafety" cap is placed onto the bottle. In one embodiment, the device for doing this is a Surekap™ Model SK600 device. The next station along the conveyor is the foil check station as discussed above. After the foil check, the system checks to see if a safety cap is required for the bottle and, if so, places a safety cap (e.g., a safety ring) onto the bottle with the nonsafety. In the preferred embodiment, a RFID sensor at the "safety" capper device is used to sense the RFID tag and send the data to the processing system. The processing system processes the data and determines if the bottle associated with the received RFID requires a safety cap or not. In one embodiment, the processing system checks the database and determines if this particular bottle associated with the RFID has a "safety" cap flag or not. In another embodiment, the processing system checks the database for the medication stored and cross-references it against a list to determine if it is a medication that requires a safety cap. If the bottle requires a safety cap, the processing system controls the safety capper and instructs it to place a safety cap on the bottle. Safety cappers are made, for example, by a company called E-Pak. Next, a sensor station on the conveyor line checks to determine if the right cap is on the bottle. For example, FIGS. 3A and 3B show one embodiment of the sensor station of the present invention. In the embodiment of FIG. 3, an Infrared (IR) sensor is used to sense what type of cap is on the bottle. This is possible because the addition of the safety cap adds height to the bottle having just a "nonsafety" cap. For example, the transmitter 32 and receiver 34 of the sensor is placed at a particular height that is above the "nonsafety" cap but at a height that is blocked by the presence of a safety cap on the bottle. Accordingly, as the bottle passes though the IR sensor, the IR beam emitted from the transmitter to the receiver is blocked when a safety cap is on the bottle (unblocked when only a "nonsafety" cap is on the bottle). The system is configured to trigger (dark on) when the safety cap is present as the bottle passes through the sensor. This information from the IR sensor is sent to the processing system for processing. At, or about, the same time, an RFID reader 36 along conveyor lines reads the RFID tag on the puck carrying the bottle and sends the information to the processing system which is configured to determine if the right cap is on the bottle. For example, if the processing system detects the presence of a safety cap based on the data received from the IR sensor, the processing system will check the RFID data against the database to ensure that the bottle requires a safety cap. And vice versa, if a safety cap is not detected, the processing system will check the RFID data against the database to ensure that the bottle does not need a safety cap. If the processed information from the RFID and IR sensor does not match, the processing system will note this and will control the system to divert the bottle off the conveyor line to a reject holding queue. In other words, if the processing system determines that the bottle has the wrong type of cap, the processing system will instruct the system to divert the bottle off the conveyor line.

Figure 4:
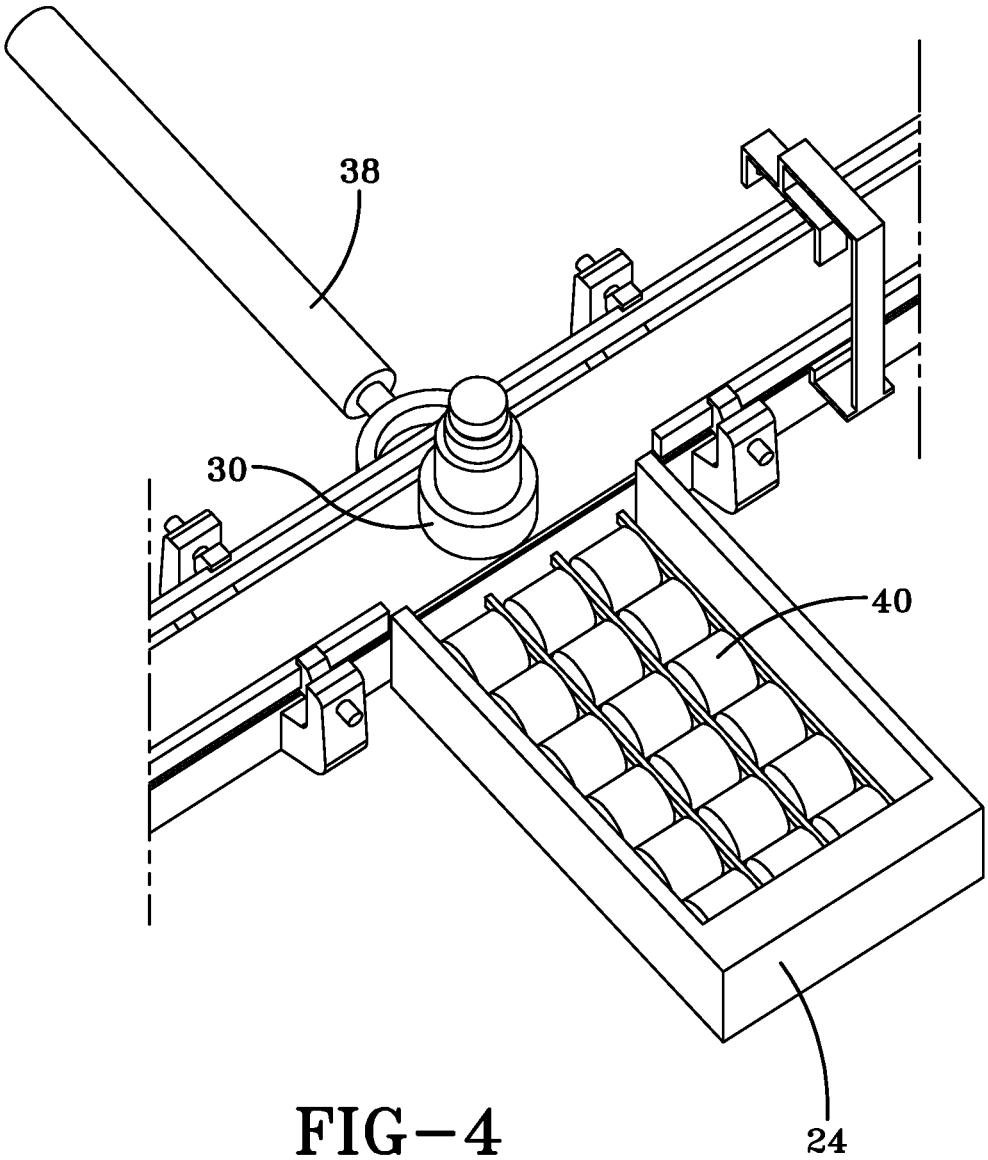
FIG. 4 illustrates one embodiment of the reject holding queue of the present invention.

FIG. 4 illustrates one embodiment of the reject holding queue of the present invention. As the bottle passes by the reject holding queue, a sensor (e.g., IR sensor) detects the passing bottle and sends the information to the processing system. The processing system is configured to take this data and to control the system to divert the bottle to the reject holding queue if the system has determined the wrong cap is on the bottle. For example, if the system has determined that a safety cap is required on the bottle and it is missing, the processing system will control the conveyor system to divert the bottle off the conveyor line to the reject holding queue. In this embodiment, a bar-like device 38 is pneumatically activated by the processing system to push the bottle (and puck) off the conveyor line into the reject holding queue. In this embodiment, the reject holding queue is a rectangular shaped platform with a railing that holds the bottles on the platform. The reject holding queue has an opening on the end attached to the conveyor line so that bottles can enter the platform from the conveyor line. In the embodiment shown, rollers 40 are placed on the platform to allow movement of the bottle on the platform. In one embodiment, a communication can be sent to an employee to attend to the "rejected" bottle and/or an alert signal can be activated to alert employees of the "rejected" bottle.

The disclosed integrated capper system increases efficiency by using one conveyor line for "non-safety" and safety cap bottles. In an example embodiment, a non-safety cap is added to all bottles while a safety cap is added only to bottles that require a safety cap. Additionally, the presence of a safety cap for required bottles is confirmed later during processing. If a safety cap is not detected on a bottle that requires one, the bottle is diverted from the conveyor line allowing the other non-safety and safety cap bottles to continue processing.

What is claimed is:

1. A conveyor line system for placing non-safety caps and safety caps onto bottles, comprising:

a conveyor line for transporting bottles, wherein each of the bottles on the conveyor line are labeled with a barcode and carried in a container having an RFID tag;

a first device adapted to place non-safety caps onto bottles on the conveyor line;

a second device adapted to place safety caps onto bottles where the second device is located on a same conveyor line path as the first device and adds safety caps to existing non-safety caps placed on bottles by the first device;

a first RFID reader for reading the RFID tag of containers on the conveyor line as they pass near the location of the second device;

a first sensor for sensing if the bottles passing the first sensor have a safety cap;

a second RFID reader for reading the RFID tag of containers on the conveyor line as they pass near the location of the first sensor;

a database in communication with the processing system for storing information including the RFID information of the containers and barcode of the bottles carried in the containers;

a processing system for processing information from the first and second RFID readers and first sensor, the processing system programmed with one or more software routines executing on the processing system to: 1) process information from the first RFID reader and to provide instructions to the second device to place a safety cap onto the bottles if the system determines the bottles need a safety cap; 2) process information from the first sensor and second RFID reader and to determine if the bottles have the correct type of cap.

2. A conveyor line system according to claim 1, further comprising:

a holding platform connected to the conveyor line;

a mechanism for diverting bottles off the conveyor line onto the holding platform;

wherein the processing system is programmed with one or more software routines executing on the processing system to provide instructions to the mechanism to divert the bottles to the holding platform if the wrong cap is on the bottles.

3. A conveyor line system according to claim 2, further comprising:

a second sensor at, or near, the mechanism for diverting bottles for sensing the bottles passing the second sensor;

wherein the processing system is programmed with one or more software routines executing on the processing system to process information from the second sensor and to provide instructions to mechanism for diverting bottles to the holding platform based on the information from the second sensor.

4. A conveyor line system according to claim 1, where the mechanism for diverting is a pneumatic-driven bar.

5. A conveyor line system according to claim 1, wherein the database is configured so that the RFID information of each of the containers is linked to a barcode of the bottle each container carries.

6. A conveyor line system according to claim 1, wherein the database also stores medication information for each bottle and order identification numbers for each bottle or container.

7. A conveyor line system according to claim 1, wherein the first sensor is an infrared sensor.

8. A conveyor line system according to claim 1, wherein the processing system is programmed with one or more software routines executing on the processing system to provide an alert signal when the processing system determines that a bottle has a wrong cap.

9. A conveyor line system for placing non-safety caps and safety caps onto bottles, comprising:

a conveyor line for transporting bottles, wherein each of the bottles on the conveyor line are labeled with a barcode and carried in a container having an RFID tag;

a first device adapted to place non-safety caps onto bottles on the conveyor line;

a second device adapted to place safety caps onto bottles where the second device is located on a same conveyor line path as the first device and adds safety caps to existing non-safety caps placed onto bottles by the first device;

a first RFID reader for reading the RFID tag of containers on the conveyor line as they pass near the location of the second device;

a first sensor for sensing if the bottles passing the first sensor have a safety cap;

a second RFID reader for reading the RFID tag of containers on the conveyor line as they pass near the location of the first sensor;

a database in communication with the processing system for storing information including the RFID information of the containers;

a holding platform connected to the conveyor line;

a mechanism for diverting bottles off the conveyor line onto the holding platform;

a processing system for processing information from the first and second RFID readers and first sensor, the processing system programmed with one or more software routines executing on the processing system to: 1) process information from the first RFID reader and to provide instructions to the second device to place a safety cap onto the bottles if the system determines the bottles need a safety cap; 2) process information from the first sensor and second RFID reader and to determine if the bottles have the correct type of cap, and 3) provide instructions to the mechanism to divert the bottles to the holding platform if the wrong cap is on the bottles.

10. A conveyor line system according to claim 9, wherein the database in communication with the processing system stores barcode information on the bottles carried in the containers.

11. A conveyor line system according to claim 10, further comprising:

a second sensor at, or near, the mechanism for diverting bottles for sensing the bottles passing the second sensor;

wherein the processing system is programmed with one or more software routines executing on the processing system to process information from the second sensor and to provide instructions to mechanism for diverting bottles to the holding platform based on the information from the second sensor.

12. A conveyor line system according to claim 10, where the mechanism for diverting is a pneumatic-driven bar.

13. A conveyor line system according to claim 10, wherein the database is configured so that the RFID information of each of the containers is linked to a barcode of the bottle each container carries.

14. A conveyor line system according to claim 10, wherein the database also stores medication information for each bottle and order identification numbers for each bottle or container.

15. A method for placing non-safety caps and safety caps onto bottles carried on a conveyor line comprising the steps of:

labeling each bottle with a barcode;

placing each bottle into a container having an RFID tag;

providing a first device adapted to place non-safety caps onto bottles on the conveyor line;

providing a second device adapted to place safety caps onto bottles, where the second device is located on a same conveyor line path as the first device and adds safety caps to existing non-safety caps placed onto bottles by the first device;

providing a first RFID reader and reading the RFID tag of containers on the conveyor line as they pass near the location of the second device;

providing a first sensor for sensing if the bottles passing the first sensor have a safety cap;

providing a second RFID reader and reading the RFID tag of containers on the conveyor line as they pass near the location of the first sensor;

providing a database in communication with the processing system and storing information including the RFID information of the containers and barcode of the bottles carried in the containers;

providing a processing system for processing information from the first and second RFID readers and first sensor, the processing system programmed with one or more software routines executing on the processing system to: 1) process information from the first RFID reader and to provide instructions to the second device to place a safety cap onto the bottles if the system determines the bottles needs a safety cap; 2) process information from the first sensor and second RFID reader and to determine if the bottles have the correct type of cap.

16. A method according to claim 15, further comprising the steps of:

providing a holding platform connected to the conveyor line;

diverting bottles off the conveyor line onto the holding platform;

wherein the processing system is programmed with one or more software routines executing on the processing system to provide instructions to the mechanism to divert the bottles to the holding platform if the wrong cap is on the bottles.

17. A method according to claim 16, further comprising:

providing a second sensor at, or near, the mechanism for diverting bottles for sensing the bottles passing the second sensor;

wherein the processing system is programmed with one or more software routines executing on the processing system to process information from the second sensor and to provide instructions to mechanism for diverting bottles to the holding platform based on the information from the second sensor.

18. A method according to claim 15, where the mechanism for diverting is a pneumatic-driven bar.

19. A method according to claim 15, wherein the database is configured so that the RFID information of each of the containers is linked to a barcode of the bottle each container carries.

20. A method according to claim 15, wherein the database also stores medication information for each bottle and order identification numbers for each bottle or container.

* * * * *